US006332805B2

(12) United States Patent
Aoki

(10) Patent No.: US 6,332,805 B2
(45) Date of Patent: Dec. 25, 2001

(54) STRUCTURE FOR CONNECTING FLAT CIRCUIT MEMBER

(75) Inventor: Hiroshi Aoki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/797,808

(22) Filed: Mar. 5, 2001

(30) Foreign Application Priority Data

Mar. 3, 2000 (JP) ..... 12-058982

(51) Int. Cl.[7] ..... H01R 12/24
(52) U.S. Cl. ..... 439/495; 439/492
(58) Field of Search ..... 439/495, 492, 439/422–429, 67, 77, 499

(56) References Cited

U.S. PATENT DOCUMENTS 3,675,180 * 7/1972 Podmore ..... 439/877
4,285,561 * 8/1981 Chow ..... 439/422
4,718,859 * 1/1988 Gardner ..... 439/329
5,299,954 * 4/1994 Ishii ..... 439/422

FOREIGN PATENT DOCUMENTS 9-22760 1/1997 (JP) ..... H01R/23/68

OTHER PUBLICATIONS

Patent Abstracts of Japan. 09–022760, Jan. 21, 1997.

* cited by examiner

*Primary Examiner*—Paula Bradley
*Assistant Examiner*—Ann M McCamey
(74) *Attorney, Agent, or Firm*—Sughrue Mion, PLLC

(57) ABSTRACT

A flat circuit member (12) has a through hole portion (14) therethrough. A conductor portion (13) is disposed on a surface of the flat circuit member (12), and has a portion penetrated by the through hole portion (14) in a thickness direction of the conductor portion (13). The flat circuit member (12) is electrically connected to a terminal (30) so that an inserting portion (34) of the terminal (30) is inserted in the through hole portion (14), a guide portion (32) of the terminal (30) extends along a rear surface of the flat circuit member (12), and a pressing piece (35) extends toward the conductor portion (13) and presses the flat circuit member (12) toward the guide portion (32).

4 Claims, 3 Drawing Sheets

STRUCTURE FOR CONNECTING FLAT CIRCUIT MEMBER

BACKGROUND OF THE INVENTION

1. Field of the Invention

The present invention relates to a structure for connecting a flat circuit member. More particularly, the present invention relates to a structure for electrically connecting a conductor of a flat circuit member to a terminal.

The present application is based on Japanese Patent Application No. 2000-058982, which is incorporated herein by reference.

2. Description of the Related Art

Conventionally, a connector for connecting a flexible printed circuit (i.e., FPC) cable has been proposed in a "FPC-Board Connection Structure In Portable Telephone" in Unexamined Japanese Patent Publication No. Hei. 9-22760. Referring to FIG. 5, a description will be given hereafter of the connector for connecting the FPC cable.

As shown in FIG. 5, a structure 60 for connecting an FPC and a substrate in a portable telephone is arranged such that a holding base 62 is mounted on an upper surface of a substrate 61, contacts 63 are attached to the holding base 62, a pair of holding pieces 64 are formed on both sides of the contacts 63, connecting pads 66 are exposed on an FPC 65, and a pair of retaining holes 67 are formed on both sides of the connecting pads 66.

According to this connecting structure 60, since the connecting pads 66 are brought into contact with the contacts 63 by merely fitting the holding pieces 64 of the substrate 61 in the retaining holes 67 of the FPC 65, if, for instance, an external force is applied to the FPC 65, a lateral deviation occurs in the FPC 65. Hence, there is a problem in that the contact between the contacts 63 and the connecting pads 66 becomes insufficient, resulting in faulty continuity.

In addition, since the holding pieces 64 of the substrate 61 are merely fitted in the retaining holes 67 of the FPC 65, a widthwise central portion of the FPC 65, in particular, cannot be sufficiently pressed against the substrate 61 side.

For this reason, there is a problem in that the contact resistance between the contacts 63 and the connecting pads 66 becomes instable.

SUMMARY OF THE INVENTION

The present invention has been devised in view of the above-described problems, and its object is to provide a structure for connecting a flat circuit member which makes it possible to prevent faulty continuity and stabilize the contact resistance.

To achieve the above object, according to a first aspect of the present invention, there is provided a structure for electrically connecting a flat circuit member to a terminal. More specifically, the structure according to the first aspect of the present invention comprises a terminal, a flat circuit member attachable to the terminal, the flat circuit member having a through hole portion therethrough, a conductor portion having a portion penetrated by the through hole portion in a thickness direction of the conductor portion, the conductor portion being disposed on a surface of the flat circuit member, a guide portion formed on the terminal, an inserting portion insertable in the through hole portion of the flat circuit member, the inserting portion being connected to the guide portion, and a pressing piece extending from a distal end of the inserting portion. In the structure, when the flat circuit member is electrically connected to the terminal, the inserting portion of the terminal is inserted in the through hole portion of the flat circuit member, the guide portion of the terminal extends along a rear surface of the flat circuit member, and the pressing piece extends toward the conductor portion of the flat circuit member and presses the flat circuit member toward the guide portion.

In the structure for connecting a flat circuit member thus constructed, the through hole portion is formed in the conductor portion o f the flat circuit member, and the through hole portion is passed over the pressing piece of the terminal so as to be fitted over the inserting portion. Then, the conductor portion is pressed by the pressing piece. For this reason, even if, for instance, an external force is applied to the flat circuit member, it is possible to prevent a lateral deviation from occurring in the flat circuit member.

Here, the flat circuit member in one example is a flexible flat cable (FFC) in which a plurality of conductor portions are exposed on a rear surface side of a belt-shaped flat portion, and a ribbon wire ( so-called flat harness), a flexible printed circuit (FPC), o r t he like may be additionally used as the flat circuit member.

In this case, a plurality of the above-described terminals may be provided. Since the plurality of conductor portions are individually pressed by the pressing pieces, it is possible to stabilize the contact resistance between the conductor portions and the terminals.

According to a second aspect of the present invention, it is preferable that the structure further comprises a spring portion formed by partially cutting the guide portion so as to rise up from the guide portion toward the pressing piece, wherein the flat circuit member is electrically connected to the terminal, so that the conductor portion of the flat circuit member is clamped between the pressing piece and the spring portion. Since the spring portion is provided in the guide portion, the conductor portion of the flat circuit member is more reliably clamped by the pressing piece and the spring portion. Accordingly, the lateral deviation or the faulty continuity of the flat circuit member can be prevented more reliably.

According to a third aspect of the present invention, it is preferable that the structure further comprises a housing into which the terminal is insertable, and a cover member, wherein the cover member covers the guide portion, the inserting portion, and the pressing piece. Accordingly, the terminals are protected as the guide portions, the inserting portions, and the pressing pieces are covered with the cover member.

According to a fourth aspect of the present invention, it is preferable that the housing has an opening adopted to be covered by the cover member, and the cover member has a pair of protrusions, and wherein, after the terminal has been inserted in the housing, the cover member covers the opening of the housing so that the flat circuit member and the terminal are sandwiched between the cover member and the housing while the pair of protrusions press the flat circuit member.

The advantages of the structure for connecting a flat circuit member described above are as follows.

In accordance with the first aspect of the present invention, provided that a plurality of the above-described terminals and a plurality of the above-described conductor portions are provided, since the through hole portions formed in the conductor portions of the flat circuit member are fitted over the inserting portions, and the conductor portions are pressed by the respective pressing pieces, even if, for instance, an external force is applied to the flat circuit member, a lateral deviation does not occur in the flat circuit member. Accordingly, since a state of contact between the conductor portions and the terminals is reliably maintained, faulty continuity can be prevented, and the contact resistance between the conductor portions and the terminals can be obtained stably.

Further, in accordance with the second aspect of the present invention, the conductor portions of the flat circuit member can be clamped between the pressing pieces and the spring portions more reliably. Hence, the lateral deviation or the faulty continuity of the flat circuit member can be prevented more reliably.

Furthermore, in accordance with the third aspect of the present invention, the terminals are protected as the guide portions, the inserting portions, and the pressing pieces are covered with the cover member, so that the quality improves.

The above and other objects, features and advantages of the present invention will become more apparent from the following detailed description of the present invention when read in conjunction with the accompanying drawings.

DETAILED DESCRIPTION OF THE PREFERRED EMBODIMENT

Referring now to the accompanying drawings, a detailed description will be given of an embodiment of the present invention.

Figure 1:
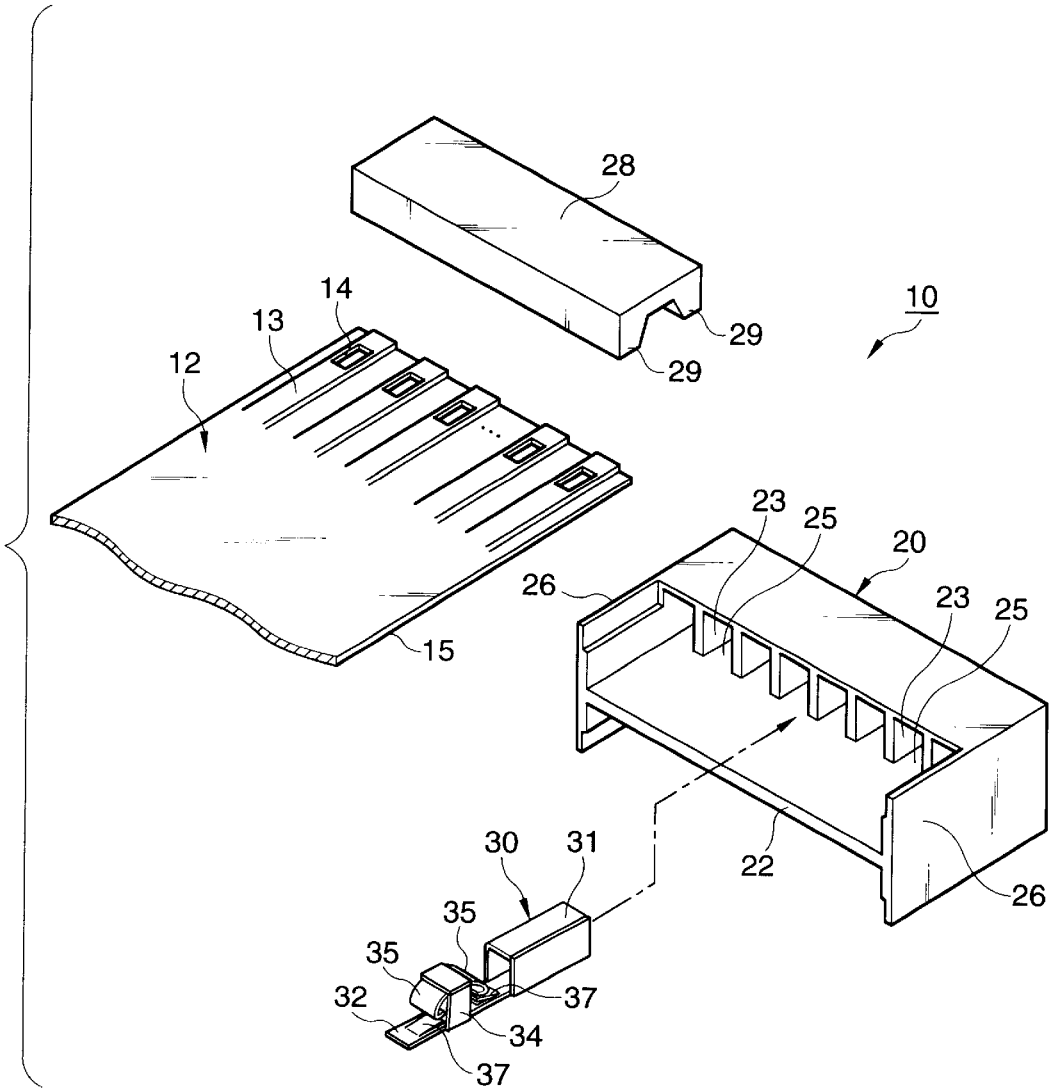
FIG. 1 is an exploded perspective view of an embodiment of the present invention.

As shown in FIG. 1, a structure 10 for connecting a flat circuit member in accordance with an embodiment of the present invention is one in which, in order to electrically connect conductor portions 13 provided on a surface 15 of a flat circuit member 12 and terminals 30 fixed in a housing 2, the flat circuit member 12 is fixed in the housing 20 in a state in which the conductor portions 13 are in contact with the terminals 30. The structure 10 for connecting a flat circuit member is comprised of through hole portions 14 provided in the flat circuit member 12 in such a manner as to penetrate portions of the conductor portions 13 in the thickness direction; guide portions 32 which are respectively provided on the terminals 30 and extend along a rear surface 15 of the flat circuit member 12; inserting portions 34 which are respectively connected to the guide portions 32 and are insertable in the through hole portions 14; and pairs of pressing pieces 35 which respectively extend from distal ends of the inserting portions 34 toward the conductor portions 13. The arrangement provided is such that as the pressing pieces 35 press the flat circuit member 12 toward the guide portions 32, the flat circuit member 12 is fixed to the housing 20.

The flat circuit member 12 in the illustrated example is a flexible flat cable (FFC) in which the plurality of conductor portions 13 are exposed on the rear surface side of a belt-shaped flat portion, but the flat circuit member 12 is not limited to the same. For example, a ribbon wire (so-called flat harness), a flexible printed circuit (FPC), or the like may be additionally used as the flat circuit member 12.

The housing 20 is divided into upper and lower parts by a partition plate 22, a plurality of accommodating portions 25 are formed by partition walls 23 in the divided upper and lower parts, and female terminal portions 31 of the terminals 30 are received in the plurality of accommodating portions 25. The housing 20 has a cover member 28 for covering the guide portions 32, the inserting portions 34, and the pressing pieces 35 of the terminals 30.

It should be noted that the cover member 28 covers the opening of the housing 20 as it is fitted in left and right side walls 26 of the housing 20, and that the cover member 28 has a pair of protrusions 29 for pressing the flat circuit member 12.

Figure 2:
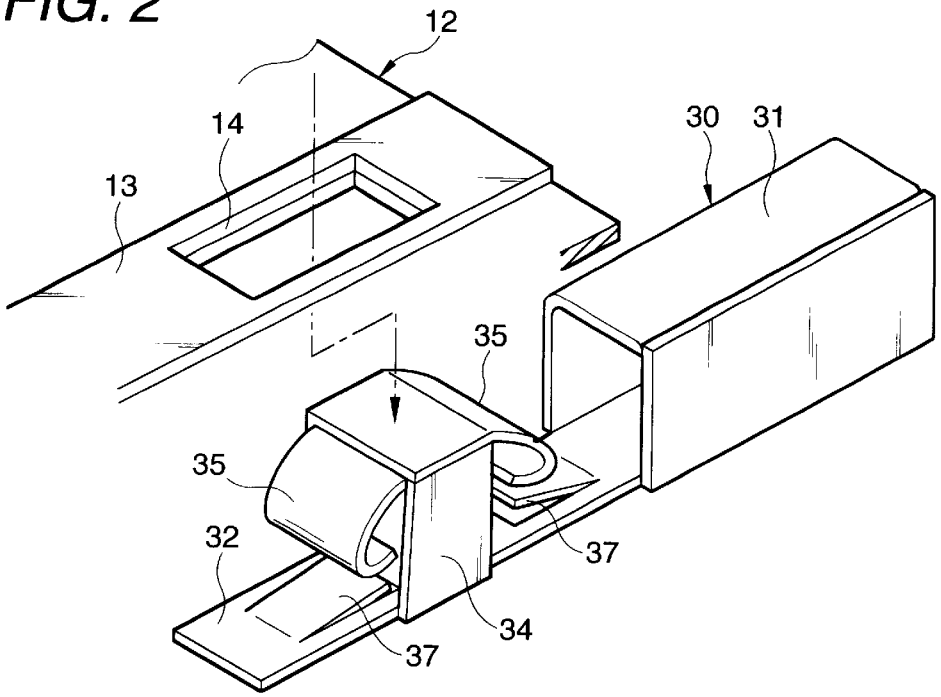
FIG. 2 is a perspective view illustrating a terminal in accordance with the embodiment of the present invention.

The terminal 30 shown in FIG. 2 is a member formed by bending a metal plate. This terminal 30 has the guide portion 32, the inserting portion 34, and the pressing pieces 35, and has a pair of spring portions 37 formed by partially cutting the guide portion 32 so as to rise up from the guide portion 32 toward the respective pressing pieces 35, so as to clamp the conductor portion 13 of the flat circuit member 12 between the pressing pieces 35 and the spring portions 37.

Further, the terminal 30 has at the rear end portion of the guide portion 32 the female terminal portion 31 to be connected to an unillustrated male terminal.

Figure 3:
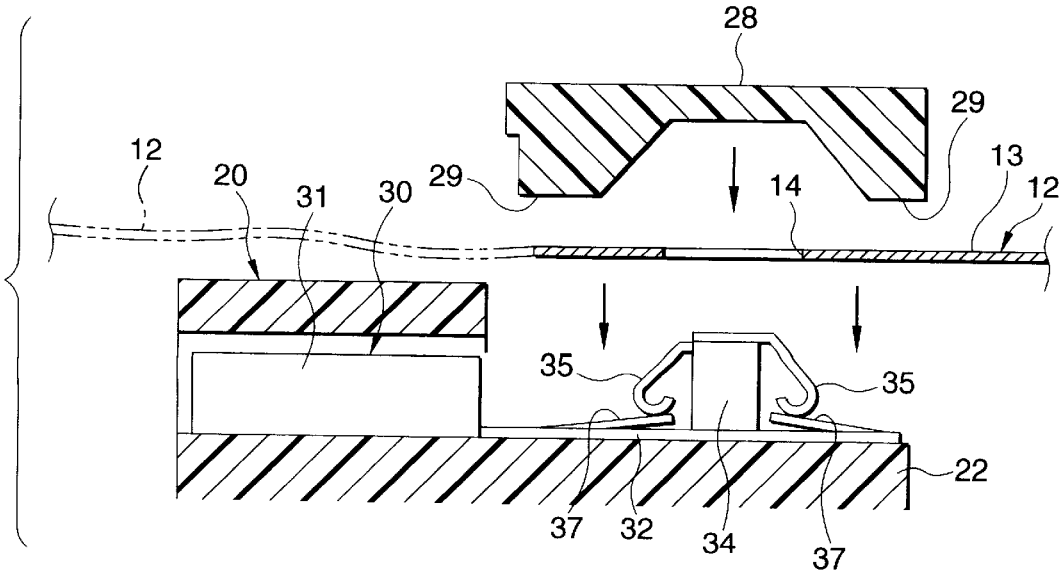
FIG. 3 is a cross-sectional view explaining the operation of the embodiment of the present invention.
Figure 4:
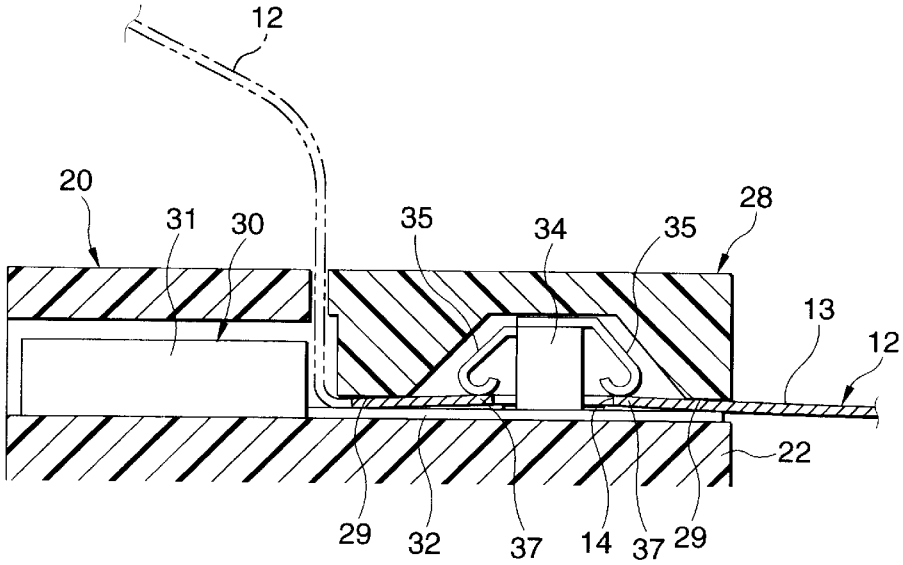
FIG. 4 is a cross-sectional view explaining the operation of the embodiment of the present invention.
Figure 5:
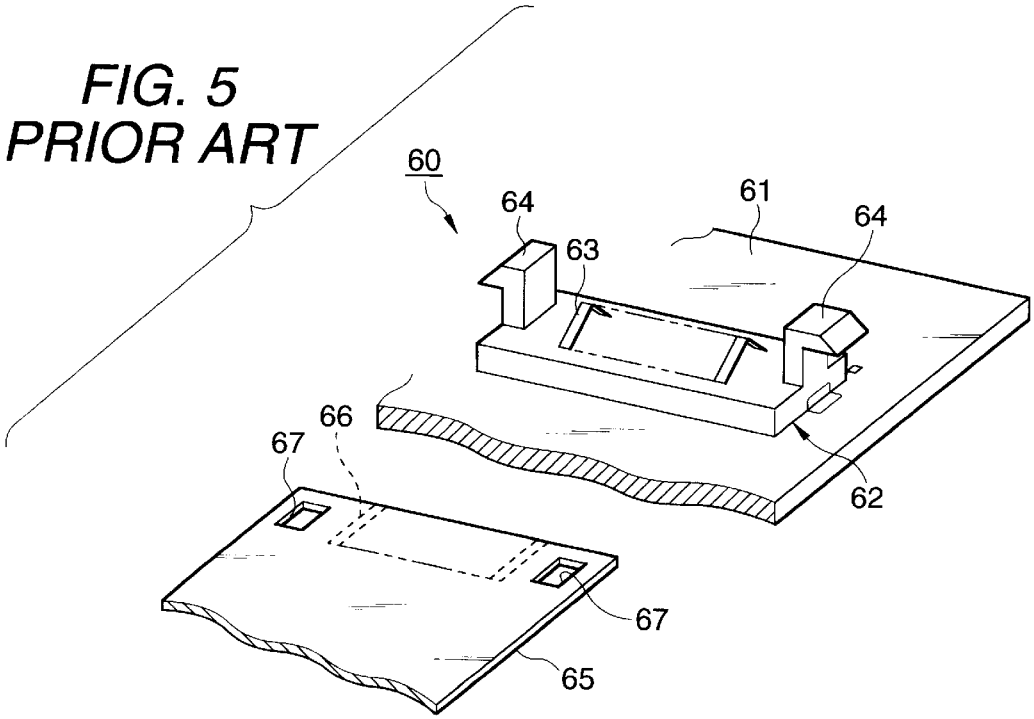
FIG. 5 PRIOR ART
FIG. 5 is a perspective view illustrating a conventional structure for connecting an FPC and a substrate.

Referring to FIGS. 1, 3, and 4, a description will be given of the operation of the above-described structure 10 for connecting a flat circuit member.

First, the female terminal portions 31 of the terminals 30 are inserted into the accommodating portions 25 of the housing 20 shown in FIG. 1 in the direction of the arrow, and the guide portions 32, the inserting portions 34, the pressing pieces 35, and the spring portions 37 of the terminals 30 are arranged at the opening of the housing 20, as shown in FIG. 3.

Next, the flat circuit member 12 is arranged above the opening of the housing 20, and the conductor portions 13 are set facing upward.

Next, the flat circuit member 12 is lowered in the direction of the arrows to allow the pairs of pressing pieces 35 to be passed through the through hole portions 14 in the conductor portions 13, thereby fitting the flat circuit member 12 to the inserting portions 34. As a result, the plurality of conductor portions 13 are individually pressed by the pressing pieces 35 and are fixed to the housing 20. At this time, the flat circuit member 12 is pressed by the spring portions 37 of the guide portions 32 as well.

For this reason, even if, for instance, an external force is applied to the flat circuit member 12, it is possible to prevent a lateral deviation from occurring in the flat circuit member 12. Accordingly, since the state of contact between the conductor portions 13 and the terminals 30 is maintained reliably, it is possible to prevent faulty continuity.

In addition, since the plurality of conductor portions 13 are individually pressed by the pressing pieces 35, it is possible to stabilize the contact resistance between the conductor portions 13 and the terminals 30.

Next, the cover member 28 is lowered in the direction of the arrow to cover the opening in the housing 20, as shown in FIG. 4. As a result, the guide portions 32, the inserting portions 34, the pressing pieces 35, and the spring portions 37 of the terminals 30 are covered with the cover member 28 so as to protect the terminal 30.

In addition, as the opening in the housing 20 is covered with the cover member 28, the conductor portions 13 of the flat circuit member 12 are pressed by the protrusions 29 of the cover member 28. For this reason, even if the through hole portions 14 in some of the plurality of conductor portions 13 have not passed over the pressing pieces 35, the flat circuit member 12 is pressed by the protrusions 29 of the cover member 28, thereby making it possible to fit all the through hole portions 14 over the inserting portions 34.

It should be noted that the structure for connecting a flat circuit member is not limited to the above-described embodiment, and appropriate modifications, improvements, and the like are possible.

For example, although in the above-described embodiment a description has been given of the example in which the terminals are formed by bending a metal plate, the terminals may be formed by another method.

Further, although a description has been given of the terminals as being female terminals, the terminals may be male terminals.

Furthermore, although a description has been given of the example in which the conductor portions of the flat circuit member are connected to the terminals in such a way as to face upward, the conductor portions of the flat circuit member may be connected to the terminals in such a way as to face downward. In addition, two flat circuit members may be superposed with their conductors facing outward, and may be connected to the terminals in this state.

Further, although in the above-described embodiment the housing is fixed to an end portion of the flat circuit member, in the present invention the housing may be fixed at an arbitrary position in the longitudinal direction in the flat circuit member, as shown by the two-dot chain lines in FIGS. 3 and 4.

In accordance with such a form, the connector for a flat circuit member in accordance with the present invention can be used as a branch connector of a flat circuit member.

In addition, the material, shape, dimensions, form, number, place to be located, and the like of each of the flat circuit member, the housing, and the terminals which have been described by way of example in the above-described embodiment are arbitrary insofar as the present invention can be attained, and are therefore not limited.

What is claimed is:

1. A structure for electrically connecting a flat circuit member to a terminal, comprising:

a terminal;

a flat circuit member attachable to the terminal, the flat circuit member having a through hole portion therethrough;

a conductor portion having a portion penetrated by the through hole portion in a thickness direction of the conductor portion, the conductor portion being disposed on a surface of the flat circuit member;

a guide portion formed on the terminal;

an inserting portion insertable in the through hole portion of the flat circuit member, the inserting portion being connected to the guide portion; and a pressing piece extending from a distal end of the inserting portion, wherein the flat circuit member is electrically connected to the terminal, so that the inserting portion of the terminal is inserted in the through hole portion of the flat circuit member, the guide portion of the terminal extends along a rear surface of the flat circuit member, and the pressing piece extends toward the conductor portion of the flat circuit member and presses the flat circuit member toward the guide portion.

2. The structure of claim 1, further comprising a spring portion formed by partially cutting the guide portion so as to rise up from the guide portion toward the pressing piece, wherein the flat circuit member is electrically connected to the terminal, so that the conductor portion of the flat circuit member is clamped between the pressing piece and the spring portion.

3. The structure of claim 1, further comprising a housing into which the terminal is insertable, and a cover member, wherein the cover member covers the guide portion, the inserting portion, and the pressing piece.

4. The structure of claim 3, wherein the housing has an opening adopted to be covered by the cover member, and the cover member has a pair of protrusions, and wherein, after the terminal has been inserted in the housing, the cover member covers the opening of the housing so that the flat circuit member and the terminal are sandwiched between the cover member and the housing while the pair of protrusions press the flat circuit member.

* * * * *